US007624712B1

(12) United States Patent
Pursifull

(10) Patent No.: US 7,624,712 B1
(45) Date of Patent: Dec. 1, 2009

(54) APPROACH FOR ENGINE START SYNCHRONIZATION

(75) Inventor: Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 33 days.

(21) Appl. No.: 12/122,906

(22) Filed: May 19, 2008

(51) Int. Cl.
*F02D 41/06* (2006.01)

(52) U.S. Cl. ..... 123/179.4; 123/179.7; 123/179.16

(58) Field of Classification Search ..... 123/436, 123/491, 179.4, 179.7, 179.14, 179.16
See application file for complete search history.

(56) References Cited

U.S. PATENT DOCUMENTS

| | | | | |
|---|---|---|---|---|
| 5,595,161 | A | 1/1997 | Ott et al. | |
| 5,767,394 | A | 6/1998 | Butts et al. | |
| 6,170,462 | B1 | 1/2001 | Kondo | |
| 6,874,359 | B2 | 4/2005 | Shimizu | |
| 7,011,063 | B2 * | 3/2006 | Condemine et al. | 123/179.4 |
| 7,027,911 | B2 * | 4/2006 | Nishikawa et al. | 701/112 |
| 7,142,973 | B2 | 11/2006 | Ando | |
| 7,177,755 | B2 * | 2/2007 | Nishikawa et al. | 701/112 |
| 7,243,627 | B2 * | 7/2007 | Izumi et al. | 123/90.17 |
| 7,441,541 | B2 * | 10/2008 | Nakamura et al. | 123/333 |
| 7,472,016 | B2 * | 12/2008 | Takeyama et al. | 701/113 |
| 2003/0041831 | A1 * | 3/2003 | Aoki et al. | 123/179.4 |
| 2008/0092841 | A1 * | 4/2008 | Takahashi | 123/179.16 |

* cited by examiner

*Primary Examiner*—Hai H Huynh
(74) *Attorney, Agent, or Firm*—Allan J. Lippa; Alleman Hall McCoy Russell & Tuttle LLP

(57) ABSTRACT

A method of starting an engine is provided. The engine includes a cylinder and a fuel injector configured to directly inject fuel into the cylinder. The method includes: at an engine start condition, receiving a sensed engine position, in response to the sensed engine position correlating with a stored engine stop position, injecting fuel directly into the cylinder at a next suitable engine position for a first combustion cycle, and in response to the sensed engine position not correlating with the stored engine stop position, rotating a shaft of the engine an angular distance without injecting fuel directly into the cylinder until the sensed engine position correlates with another parameter, and thereupon, injecting fuel directly into the cylinder at a next suitable engine position for a first combustion cycle.

20 Claims, 3 Drawing Sheets

APPROACH FOR ENGINE START SYNCHRONIZATION

BACKGROUND AND SUMMARY

Engine control strategies may control fuel injection for combustion based on engine position. For example, engine position may be determined based on an angular position of one or more shafts of the engine, such as a camshaft or a crankshaft. The angular position of a shaft may be detected by a shaft position sensor configured to send a signal train indicative of position to a controller. In a particular example, an engine may include a fine resolution crankshaft having a crank wheel that includes sixty teeth that generates one hundred twenty edges each revolution. The engine further includes a coarse angular resolution camshaft having five targets that generate ten edges per camshaft revolution. The controller receives signal trains from the sensors based on detection of the teeth of the crankshaft and the targets of the camshaft and the controller time stamps and processes the signals of each signal train to determine the engine position.

At engine startup, in order to perform accurate fuel injection control for combustion, the controller and the engine position may be synchronized. Stated another way, engine position becomes known to the controller. In an example where engine position is determined based on signals from the camshaft position sensor, the engine may be cranked until the camshaft position sensor detects a reference marker, such as a cylinder identification (CID) of the camshaft. Upon detection of the CID, the controller may determine the position of the engine and may cause fuel injection to be performed for combustion at the next suitable engine position. Typically, the camshaft position sensor may detect the CID in approximately 270° to 740° of angular rotation of the camshaft or three edges of the camshaft targets to synchronize the engine position with the controller. It, it will be appreciated that a camshaft position sensor with multiple targets may be synchronized more quickly than those with single targets.

Fast engine startup may be desirable since a vehicle operator may perceive fast engine startup as an indication of vehicle reliability, among other things. For fast engine startup, minimal rotation of the camshaft to synchronize the controller and the engine position may be desired. In one approach, fast engine startup may be achieved by synchronizing the controller and the engine position based on the first identification of the CID (including camshaft position sensor systems with multiple targets per revolution) by the camshaft position sensor.

However, the inventor herein has recognized some issues with the above approach. In particular, in some cases, the first identification of the CID may be inaccurate resulting in the controller and the engine position being out of synchronization. Moreover, the lack of synchronization may lead to fuel injection control having reduced accuracy. Lack of synchronization between the controller and the engine position particularly may affect startup of a direct fuel injection engine. In particular, since fuel is injected directly into the cylinder, if the engine position known by the controller is inaccurate, fuel may be injected into the cylinder at an engine position that is inappropriate for combustion resulting in ineffective combustion or no combustion of the fuel. Thus, control of fuel injection with reduced accuracy as a result of the controller and the engine position being out of synchronization may result in ineffective combustion or no combustion which may lead to no-starts or miss-starts of the direct fuel injection engine. Moreover, no-starts and miss-starts as a result of the controller and engine position being out of synchronization may be more prevalent at cold temperatures due to slow shaft rotation, such as at a temperature less than 20° Fahrenheit.

At least some of the above issues may be overcome, in one approach, by a method of starting an engine, the engine including a cylinder and a fuel injector configured to directly inject fuel into the cylinder, the method comprising: at an engine start condition, receiving a sensed engine position; in response to the sensed engine position correlating with a stored engine stop position, injecting fuel directly into the cylinder at a next suitable engine position for a first combustion cycle; and in response to the sensed engine position not correlating with the stored engine stop position, rotating a shaft of the engine an angular distance without injecting fuel directly into the cylinder until the sensed engine position correlates with another parameter, and thereupon, injecting fuel directly into the cylinder at a next suitable engine position for a first combustion cycle.

In one example, a stored engine stop position is determined at the most recent engine shutdown. For example, a shaft position sensor may detect the shaft position and upon detection of a shaft of the engine reaching a standstill state the engine stop position may be determined based on the shaft position while taking into consideration reversals in shaft rotation during the course of engine shutdown in order to accurately determine the engine position. The determined engine stop position may be stored in memory and may be utilized at the subsequent engine startup.

By synchronizing the controller and the engine position based on a correlation between a sensed engine position and a stored engine stop position, confidence in the engine position may be improved for quick and accurate engine startup. In other words, the stored engine start position may be confirmed at the moment of receiving the first indication of the sensed engine position and fuel injection for engine startup may be performed with confidence. It will be appreciated that it may take three indications of shaft position (e.g., three camshaft target edges) to determine engine position, but it only takes one indication to confirm the stored engine stop position as being the actual engine position. With each subsequent indication of sensed shaft position, the engine stop position may further be confirmed.

Furthermore, in the event that the sensed engine position and the stored engine stop position (incremented as crankshaft displacement is sensed) are not correlated, fuel injection may be delayed in order to increase the confidence in the engine position by rotating the shaft to determine a additional indications of the sensed engine position that may correlate with another parameter. For example, the additional indication of the sensed engine position may correlate with the stored engine stop position and fuel injection may be performed. As another example, the stored engine stop position may be dismissed and the shaft may be rotated further in order to repeatedly detect a sensed engine position and fuel injection may be performed based on the correlation with the repeated detection of the sensed engine position. By delaying fuel injection in order to determine the engine position with confidence, the likelihood of no-starts and miss-starts may be reduced and difficult restarts may be virtually avoided. In this way, engine startup may be made more robust.

DETAILED DESCRIPTION

The present disclosure is directed to a propulsion system of an automobile. More particularly, the present disclosure is directed to an approach for synchronizing a controller with a position of a direct fuel injection engine of the automobile in order to perform robust startup of the direct injection engine with a reduced likelihood of no-starts or miss-starts.

Figure 1:
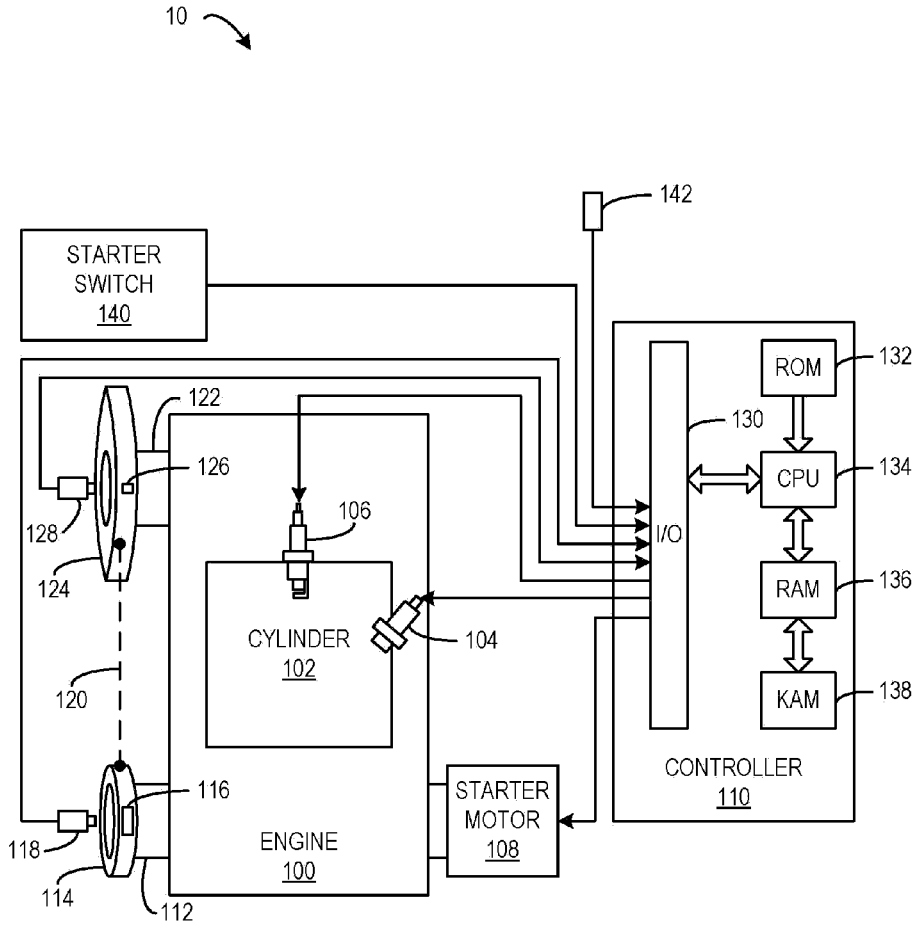
FIG. 1 is a schematic block diagram of an internal combustion engine and powertrain system.

FIG. 1 is a schematic diagram showing one cylinder 102 of multi-cylinder direct engine 100, which may be included in propulsion system 10 of an automobile. Fuel injector 104 is shown coupled directly to cylinder 102 for injecting fuel directly therein in proportion to a pulse width of a signal received from controller 110. In this manner, fuel injector 104 provides what is known as direct injection of fuel into cylinder 102. The fuel injector may be mounted in the side of the combustion chamber or in the top of the combustion chamber, for example. Fuel may be delivered to fuel injector 104 by a fuel system (not shown) including a fuel tank, a fuel pump, and a fuel rail. It will be appreciated that the engine may include additional cylinders, each of which may be coupled to a fuel injector that directly injects fuel into that cylinder in what be referred to as a direct injection engine. Spark plug 106 may generate a spark for combusting fuel injected into cylinder 102 in response to a spark advance signal from controller 110, under select operating modes. It will be appreciated that FIG. 1 shows only one cylinder of a multi-cylinder engine, and that each cylinder may similarly include its own set of intake/exhaust valves, fuel injector, spark plug, etc.

Cylinder 102 of engine 100 may include a piston (not shown) positioned therein. The piston may be coupled to crankshaft 112 so that reciprocating motion of the piston is translated into rotational motion of the crankshaft. Crankshaft 112 may be coupled to at least one drive wheel of a vehicle via an intermediate transmission system (not shown). Further, a starter motor 108 may be coupled to crankshaft 112 to adjust an angular position of crankshaft 112 in order to enable a starting operation of engine 100.

Crankshaft 112 may be connected to camshaft 122 via connection 120. In particular, crankshaft 112 may include a first gear disk 114 and camshaft may include a second gear disk 124 which may be linked via connection 120, such as a timing belt. Connection 120 may cause rotation of camshaft 122 based on rotation of crankshaft 112. This connection can be phased to accomplish cam timing change. Further, the size of first gear disk 114 relative to size of the second gear disk 124 may define a rotational relationship of the crankshaft and the camshaft. For example, the second gear disk may be larger than the first gear disk, thus the camshaft may rotate at a slower speed than the crank shaft (e.g. half speed).

Camshaft 122 may control actuation of valves (not shown) of cylinder 102 as well as other cylinders of engine 100. Further, it will be appreciated that the engine may include additional camshafts to control different valves of the cylinders of the engine. For example, a first camshaft may be provided to control actuation of one or more intake valves of cylinders of the engine and a second camshaft may be provided to control actuation of one or more exhaust valves of cylinder of the engine. The camshafts may be included in one or more cam actuation systems that utilize one or more of cam profile switching (CPS), variable cam timing (VCT), variable valve timing (VVT) and/or variable valve lift (VVL) systems that may be operated by controller 110 to vary valve operation.

Controller 110 is shown in FIG. 1 as a microcomputer, including microprocessor unit 134, input/output ports 130, an electronic storage medium for storing executable programs and calibration values shown as read only memory chip 132 in this particular example, random access memory 136, keep alive memory 138, and a data bus. Controller 110 may receive various signals from sensors coupled to engine 100 via input/output ports 130, such as from starter switch 140 to indicate starting/stopping of engine 100. In some examples, the engine start/stop indication may be driver commanded. For example, the starter switch may be configured to receive a key that may be used to toggle the starter switch between a key-on state in which engine starting is desired and a key-off state in which engine stopping is desired. Controller 110 may control starter motor 108 and fuel and spark based on the signal received from starter switch 140. Further, controller 110 may receive signals from an operating parameter sensor 142. Examples of operating parameters that the operating parameter sensor may be configured to detect include engine temperature, ambient temperature, engine output, fuel injection amount, fuel/air ratio, shaft speed, engine speed, etc.

Furthermore, controller 110 may be configured to receive signals from crankshaft position sensor 118 and camshaft position sensor 128. In particular, first gear disk 114 of crankshaft 112 may include a first reference marker(s) 116 that may be sensed by crankshaft position sensor 118 to indicate a position of crankshaft 112. For example, the first gear disk may have sixty teeth that generate one hundred twenty edges for each revolution of the crankshaft. Further, two teeth may be missing from the first gear disk and the gap created by the missing teeth may act as the reference marker of the crankshaft. In one example, the first reference marker(s) indicate(s) the cylinder identification (CID) or the angular position on the crankshaft at which the intake valve of the first cylinder in the firing order of the engine cylinders begins to open.

Similarly, second gear disk 124 of camshaft 122 may include a second reference marker(s) 126 that may be sensed by camshaft position sensor 128 to indicate a position of the camshaft 122. For example, the second gear disk may have five targets that generate ten edges per camshaft revolution. One of the targets may be larger than the other targets and thus may be identified as the reference marker of the camshaft. In one example, the second reference marker(s) indicate(s) the phase of the piston of the first cylinder in the firing order of the cylinders in the engine. Additional examples of reference markers that may be implemented on a gear disk to indicate an engine position may include one or more missing teeth of the gear disk, an extended protrusion, a magnet, etc. In one particular example, the crankshaft position sensor and camshaft position sensor are Hall Effect sensors.

Controller 110 may be configured to determine a position of engine 100 based on signals received from crankshaft position sensor 118 and/or camshaft position sensor 128 which may be referred to as engine tracking. For example, the controller may receive a pulse train from each of the crankshaft position sensor and the camshaft position sensor. In an engine system having two camshafts, signals provided to the controller in the pulse trains that may be used to determine engine position may include the up-edge of the first camshaft, the down-edge of the first camshaft, the up-edge of the second camshaft, the down-edge of the second camshaft, and the missing teeth of the crankshaft. In some embodiments of the engine system, under some conditions, a camshaft may drive a fuel pump of the engine system such that every pump output stroke pumps fuel and increases pressure. If the number of lobes on the camshaft is odd then the rise or drop in fuel pressure may provide camshaft position information. Thus, engine position may be determined, at least in part, based on fuel pressure. For example, on an outlet stroke, an increase of 2.25 pounds per square inch (PSI) per degree may occur and on an inlet stroke, a decrease of 0.05 PSI per degree may occur.

Controller 110 may time stamp and process the pulse trains received from the sensors. In particular, the controller may determine the angular position of each shaft by counting the number of edges or pulses since detecting the reference marker in each pulse train. By determining the angular position of the crankshaft relative to the first reference maker and determining the angular position of the camshaft relative to the second reference marker and comparing each position, the phase and position of the engine may be determined. In one example, the engine position may be determined by measuring the amount of crankshaft rotation between detection of camshaft targets. Typically, three edges (thus two angular displacements) may be used to determine crankshaft position. Further, camshaft position may be determined by 270° of angular motion (not counting the angular displacement suffered while initially accelerating to minimum signal speed).

Note that in a fixed cam timing engine or in an engine that stops and starts at a fixed, default cam timing, the camshaft position may be equivalent to the engine position.

Figure 2:
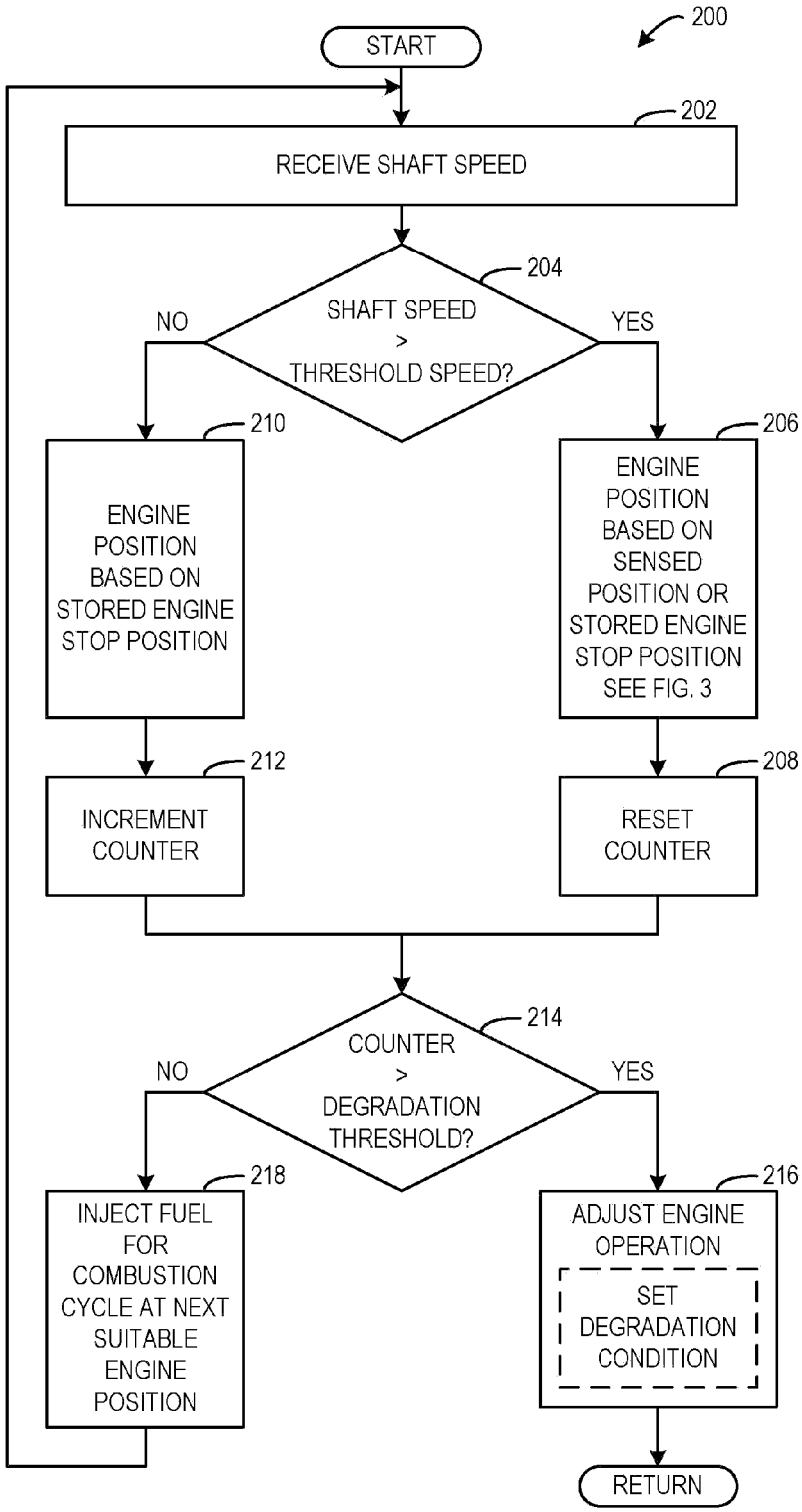
FIG. 2 is a flowchart of an example engine start synchronization method.

As noted above, under some conditions, shaft rotation speed at engine startup may be slow to the point that detection by a shaft position sensor becomes inaccurate. For example, engine startup in cold ambient temperature may result in slow cranking of the crankshaft and/or the camshaft which may result in inaccurate position sensing. FIG. 2 shows a flowchart of a method 200 for controlling fuel injection at engine startup using a sensed engine position or a stored engine stop position based on shaft rotation speed. Method 200 may include at 202, receiving a shaft rotation speed. In one example, the shaft rotation speed may be received from a speed sensor of the crankshaft. In another example, the shaft rotation speed may be received from a speed sensor of the camshaft. In another example, the shaft rotation speed may be derived from another operating parameter.

At 204, the method may include determining if the shaft rotation speed exceeds a threshold speed. The threshold speed may be set at a speed at which it is predetermined that a shaft position sensor for detecting the position of the crankshaft and/or the camshaft may function accurately. In one example, the threshold speed is set at approximately sixty rotations per minute. If it is determined that the shaft rotation speed exceeds the threshold speed the flowchart moves to 206. Otherwise, the shaft rotation speed does not exceed the threshold speed and the flowchart moves to 210.

At 206, the shaft rotation speed exceeds the threshold speed; therefore the engine position utilized for controlling fuel injection at engine startup is based on the correlation between the stored engine stop position and the sensed engine position as determined according to method 300 discussed in further detail below with reference to FIG. 3.

At 208, the method may include resetting a counter used to track shaft, position sensor, and/or engine degradation since the shaft accelerated to a suitable rotation speed.

At 210, the shaft rotation speed does not exceed the threshold speed; thus the shaft is not rotating fast enough for the shaft position sensor to accurately detect the position of the shaft. Therefore, the engine position utilized for controlling fuel injection at engine startup is based on the stored engine stop position from the previous engine shutdown.

At 212, the method may include incrementing the counter to track potential degradation of the shaft or another component of the engine system. In other words, since the shaft is not rotating at a suitable speed for position detection, one of the components of the engine system potentially may be degraded and thus degradation tracking may be conducted.

At 214, the method may include comparing the counter to a degradation threshold. The degradation threshold may be set at a predetermined number of combustion events without the shaft accelerating to a suitable rotation speed to determine that a component of the engine system has degraded. Alternatively, the threshold may be set according to a number of rotations of the shaft or set according to an operating parameter other than combustion events. If it is determined that the counter exceeds the degradation threshold, the flowchart moves to 216. Otherwise, the counter does not exceed the degradation threshold and the flowchart moves to 218.

At, 216, the counter has exceeded the degradation threshold indicating that a component of the engine system had degraded, therefore the method may include adjusting engine operation. In one example, adjusting engine operation may include ignoring the shaft position sensor signal. In another example, adjusting engine operation may include setting a degradation condition. In a particular example, setting a degradation condition may include setting one or more diagnostic trouble code(s). In another example, setting a degradation condition may include preventing engine startup.

At 218, the counter does not exceed the degradation threshold, therefore engine startup may continue and the method may include injecting fuel for a combustion cycle at the next suitable engine position based on the determined engine position. The flowchart may loop back to 202 continue performing the method until the shaft has accelerated to a speed at which the shaft position sensor may accurately detect the position of the sensor or until engine operation is adjusted to accommodate the lack of accurate detection by the shaft position sensor.

By controlling fuel injection for engine startup based on the stored engine stop position even if the shaft position sensor does not agree with the engine stop position when the shaft rotation speed is below a given instantaneous rotation speed, fuel injection control based on inaccurate engine position may be reduced or avoided. In this way engine startup may be made more robust by reducing or eliminating engine miss-starts and no-starts.

At engine startup, accurate determination of the engine position may be particularly useful for reducing the likelihood of no-starts or miss-starts in the above described direct injection engine configuration. In particular, since fuel is directly injected into the cylinder, the position of the piston and the state of the intake and exhaust valves may have an increased effect on combustion. For example, in the event that the engine position is determined with reduced accuracy and fuel is directly injected when the piston is positioned at a power stroke, ignition of the injected fuel may not occur fully.

In contrast, if a position of the engine is inaccurately determine in a port injection engine, the inaccuracy may have a decreased effect on combustion. In particular, since fuel is not injected directly into a cylinder but rather into an intake port of the cylinder, in the event that the engine position and the fuel injection are not synchronized, the fuel may remain in the intake port until the intake valve is opened and combustion may still occur.

Figure 3:
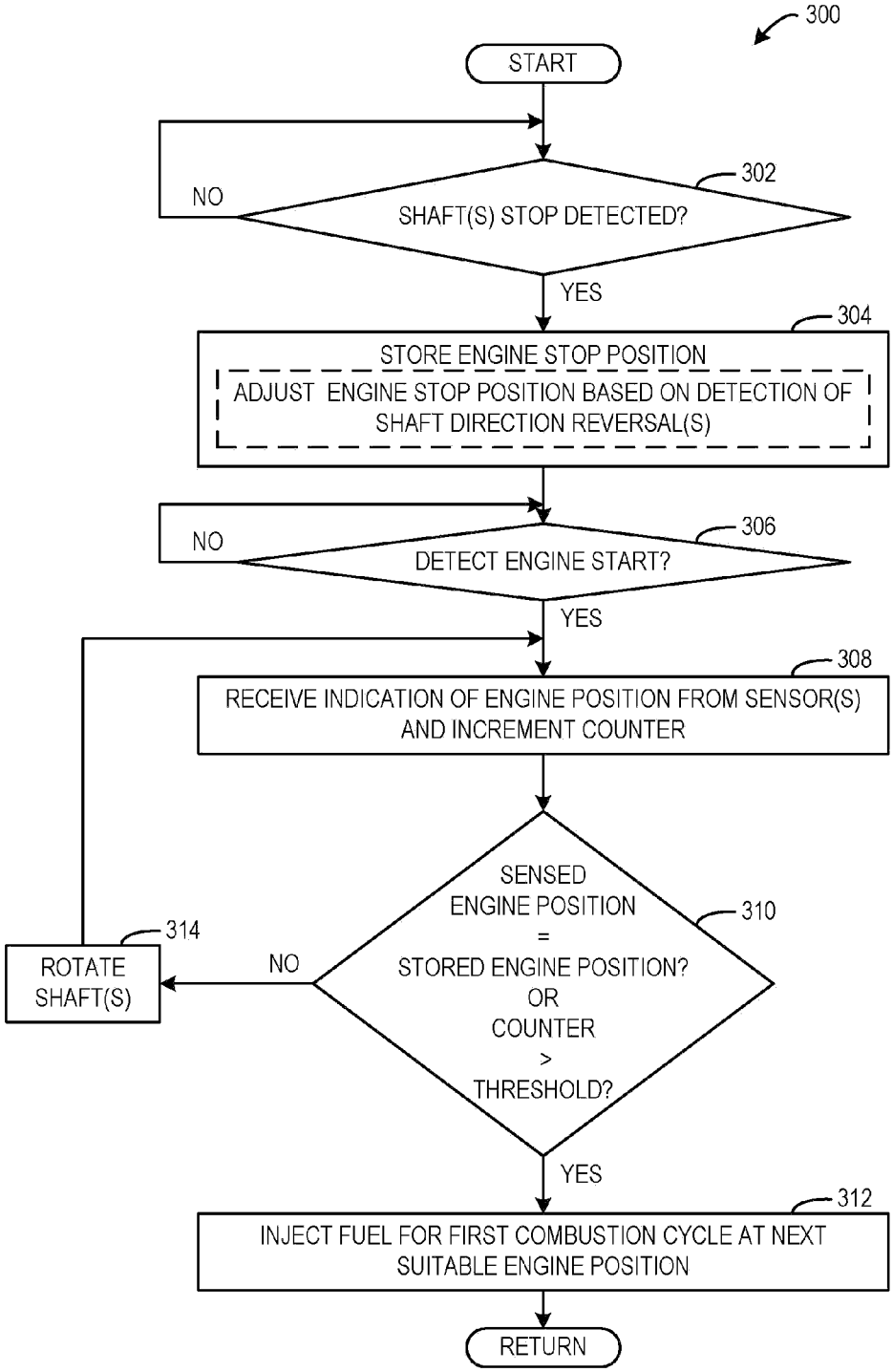
FIG. 3 is a flowchart of an example method of engine starting based on a confidence level of knowing an engine position.

FIG. 3 shows a flowchart of an example method 300 for starting a direct injection engine by synchronizing the controller with an engine position that is verified from multiple sources so that fuel injection and spark may be accurately controlled for suitable engine startup. The method 300 may include detecting stopping of the shaft(s) (e.g., camshaft or crankshaft) which may be an indication of engine stop. Stopping of the crankshaft and/or the camshaft may be detected based on the signal for the crankshaft position sensor and/or the camshaft position sensor. In particular, a stop indication may be determined when the pulse train from one or both of the sensors does not include a pulse for a threshold period of time. If it is detected that the crankshaft and/or the camshaft have/has stopped, the flowchart moves to 304. Otherwise, the flowchart loops back to 303 and continues to poll for an indication that the crankshaft and/or the camshaft have/has stopped.

At 304, the engine has come to a complete stop, thus the method may include storing the engine stop position in memory of the controller. When determining the engine stop position to be stored, reversals of the shafts may be taken into account in order to store an accurate engine stop position. In one example, a reversal may be detected by an interruption or extended period between pulses of a pulse train. Upon detection of an interruption, the sign of the angular distance may be switched to add or subtract based on the reversal.

At 306, the method may include detecting an engine start indication. In one example, an engine start indication may be provided by a signal from the starter switch indicating the starter switch is in a key-on state. If an engine stop indication is detected the flowchart moves to 308. Otherwise, the flowchart loops back to 306 and continues to poll for the engine start indication.

At 308, the method may include receiving a first indication of engine position from the crankshaft position sensor and/or the camshaft position sensor. For example, the first indication of the reference markers may include an up-edge of a first camshaft, a down-edge of the first camshaft, an up-edge of a second camshaft, a down-edge of the second camshaft, and/or a missing tooth of the crankshaft. In some embodiments where engine position is determined at least in part based on fuel pressure, the first indication may be a fuel pressure increase/decrease. Further, the method may include incrementing a counter based on receiving an indication of the sensed engine position, for tracking purposes. In other words, each time the sensed engine position is received the counter may be incremented.

At 310, the method may include determining if a sensed engine position correlates with the stored engine stop position that was determined at engine shutoff or the sensed engine position has been detected (i.e., the value of the counter) a number of times that exceeds a threshold. In one example, correlation of the sensed engine position and the stored engine stop position may include the sensed engine position equaling the stored engine stop position. In one example, assume that the first camshaft edge is used for engine position correlation. As soon as the first edge shows up in the correct position according to the initial engine position (incremented as the crank teeth come in), then the engine position is confirmed and fueling may begin. Alternately, in another example, two camshaft edges may be used for correlation. Thus, as soon as two camshaft edges show up in the correct place to confirm that the tracked engine position correlates with the stored engine stop position fueling may begin. It will be appreciated that the edge of a camshaft in one direction may be more angularly accurate than the edge in the other direction due to sensor system attributes. Thus engine position correlation may be based on only up-edges or on only down-edges. Optionally, one up-to-up period and one down-to-down period to cancel dynamic response differences between up-going and down-going edges may be used for engine position correlation. If it is determined that the engine position provided by the first indication of the sensor(s) correlates with the stored engine stop position, the flowchart moves to 313. Otherwise, the engine position provided by the first indication of the sensor(s) does not correlate with the stored engine stop position and the flowchart moves to 314.

In some embodiments, an approximation tolerance may be included in the determination of the correlation. In other words, the method may include determining if the two engine positions are approximately equal to each other within a predetermined difference threshold.

At 314, it has been determined that the engine position provided by the indication of the sensor(s) correlates with the stored engine stop position. That is, the controller is synchronized with the engine position. Therefore, the method may include directly injecting fuel into the appropriate cylinder of the engine for the first combustion cycle at the next suitable engine position.

At 316, it has been determined that the engine position provided by the indication of the sensor does not correlate with the stored engine stop position. Therefore, the method may include rotating the crankshaft and/or the camshaft an angular distance in order to receive another indication of engine position from the crankshaft position sensor and/or the camshaft position sensor by returning to 308.

Returning to 310, the method may include determining if the engine position determined from the second indication of the crankshaft position sensor and/or the camshaft position sensor correlates with the updated stored engine stop position. If it is determined that the engine position provided by the second indication of the sensor(s) correlates with the stored engine stop position, the flowchart moves to 314 to begin combustion. Otherwise, the flowcharted moves to 316 and continues to crank the engine until the sensed engine position and the stored engine stop position are synchronized.

By comparing a stored engine stop position with the first indication of the sensed engine position, the stored engine start position may be confirmed at the moment of receiving the first indication of shaft position. Thus, even though it may take three indications (e.g., camshaft gear disk edges) to determine a shaft position, it only takes one indication to confirm the shaft position and then engine position. Further, with each subsequent indication, the engine stop position may be further confirmed. In this way, quick and accurate engine startup may be achieved with confidence.

Furthermore, if the sensed engine position and the stored engine stop position do not correlate, additional engine cranking may be performed and the engine position may be determined from repeated detection of the position of the shafts which may correlate with the stored engine stop position or may be used independent of the stored engine stop position to resolve the disagreement between the assumed initial engine position and the actual engine position. Thus, by delaying fuel injection in order to increase confidence in the engine position prior to injecting fuel, the likelihood of no-starts and miss-starts may be reduced and difficult restarts may be virtually avoided. In this way, engine startup may be made more robust. It will be appreciated that, in most cases, the robust engine synchronization method adds no additional time to engine startup, except for the case of incorrect engine synchronization.

Further still, lower cost crankshaft and/or camshaft position sensors may be used in the engine system with minimal or no reductions in reliability due to the added robustness of the engine synchronization method. In this way, vehicle production costs may be reduced.

Note that the control routines and/or flowcharts included herein can be used with various engine configurations, such as those described above. The specific routines described above may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated steps or functions may be repeatedly performed depending on the particular strategy being used. Further, the described steps may graphically represent code to be programmed into the computer readable storage medium in controller 12.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, the wheel slip control may be applied to any powertrain that drives wheels and is controlled by a driver using some input device, such as, for example, electric, hybrid/electric, diesel, diesel hybrid, gasoline hybrid, fuel cell, or others. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

I claim:

1. A method of starting an engine, the engine including a cylinder and a fuel injector configured to directly inject fuel into the cylinder, the method comprising:

at an engine start condition, receiving a sensed engine position;

in response to the sensed engine position correlating with a stored engine stop position, injecting fuel directly into the cylinder at a next suitable engine position for a first combustion cycle; and in response to the sensed engine position not correlating with the stored engine stop position, rotating a shaft of the engine an angular distance without injecting fuel directly into the cylinder until the sensed engine position correlates with another parameter, and thereupon, injecting fuel directly into the cylinder at a next suitable engine position for a first combustion cycle.

2. The method of claim 1, wherein the another parameter includes the stored engine stop position.

3. The method of claim 1, wherein the another parameter includes repeated identification of the sensed engine position beyond a predetermined threshold.

4. The method of claim 1, wherein the stored engine stop position includes an engine position sensed upon the shaft reaching a standstill state at a most recent engine shutdown.

5. The method of claim 1, wherein the shaft is a camshaft and the sensed engine position is based on a sensed position of the camshaft.

6. The method of claim 5, wherein the shaft includes the camshaft and a crankshaft and the sensed engine position is based on a sensed position of the camshaft and the crankshaft.

7. An engine system comprising:

at least one cylinder having an intake valve and an exhaust valve;

a fuel injector configured to directly inject fuel into the at least one cylinder;

a shaft operatively coupled to the at least one cylinder, the shaft having a reference marker indicative of engine position;

a shaft position sensor configured to detect the reference marker; and a controller, in response to an engine start indication, at a first condition, the controller causing the fuel injector to inject fuel into the at least one cylinder at an engine position determined based on a correlation between a stored engine stop position and a sensed engine position based on a first identification of the reference marker by the shaft position sensor; and at a second condition, the controller causing the fuel injector to inject fuel into the at least one cylinder at an engine position determined based on repeated identification of the reference marker by the shaft position sensor that is not correlated with the stored engine stop position.

8. The system of claim 7, wherein fuel injection at the first condition occurs at a first amount of elapsed time after the engine start indication and fuel injection at the second condition occurs at a second amount of elapsed time after the engine start indication that is greater than the first amount of elapsed time.

9. The system of claim 7, wherein the shaft is a camshaft.

10. The system of claim 9, wherein the reference marker indicates a cylinder identification of a first cylinder of a firing order of the engine.

11. The system of claim 7, wherein the stored engine stop position includes an engine position determined based on a position of the shaft detected by the shaft position sensor upon the shaft reaching a standstill state at a most recent engine shutdown.

12. The method of claim 7, wherein the shaft includes a camshaft and a crankshaft and the sensed engine position is based on a sensed position of the camshaft and the crankshaft.

13. A method of starting an engine, the engine including a cylinder and a fuel injector configured to directly inject fuel into the cylinder, the method comprising:

receiving a shaft rotation speed;

receiving a sensed engine position;

at a first condition where the shaft rotation speed exceeds a threshold speed, in response to the sensed engine position correlating with a stored engine stop position, injecting fuel directly into the cylinder at a next suitable engine position for a first combustion cycle; and at a second condition where the shaft rotation speed does not exceed the threshold speed, injecting fuel directly into the cylinder at a first suitable engine position for a first combustion cycle based on the stored engine stop position.

14. The method of claim 13, further comprising:

at the first condition, in response to the sensed engine position not correlating with the stored engine stop position, rotating a shaft of the engine an angular distance without injecting fuel directly into the cylinder until the sensed engine position correlates with another parameter, and thereupon, injecting fuel directly into the cylinder at a next suitable engine position for a first combustion cycle.

15. The method of claim 13, further comprising:

setting a degradation condition in response to the shaft rotation speed not exceeding the threshold speed for a predetermined duration.

16. The method of claim 13, wherein the another parameter includes the stored engine stop position.

17. The method of claim 13, wherein the another parameter includes repeated identification of the sensed engine position beyond a predetermined threshold.

18. The method of claim 13, wherein the stored engine stop position includes an engine position sensed upon the shaft reaching a standstill state at a most recent engine shutdown.

19. The method of claim 13, wherein the shaft is a camshaft.

20. The method of claim 13, wherein the stored engine stop position includes an engine position sensed upon the shaft reaching a standstill state at a most recent engine shutdown.

* * * * *